US008915550B2

(12) United States Patent
Jeevanantham et al.

(10) Patent No.: US 8,915,550 B2
(45) Date of Patent: Dec. 23, 2014

(54) COLD PLANAR ANTI-STABBING MECHANISM

(75) Inventors: Gnanasekar Jeevanantham, Tamilnadu (IN); Timothy Miller, Saint Paul, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 146 days.

(21) Appl. No.: 13/414,759

(22) Filed: Mar. 8, 2012

(65) Prior Publication Data

US 2013/0234495 A1 Sep. 12, 2013

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)
USPC ..... 299/39.2; 299/39.4

(58) Field of Classification Search
USPC ..... 299/36.1, 39.1, 39.2, 39.4
See application file for complete search history.

(56) References Cited

U.S. PATENT DOCUMENTS

| | | | | |
|---|---|---|---|---|
| 4,221,434 | A | 9/1980 | Swisher, Jr. et al. | |
| 4,235,580 | A | 11/1980 | Springs et al. | |
| 4,560,207 | A | 12/1985 | Eftefield et al. | |
| 4,637,753 | A | 1/1987 | Swisher, Jr. | |
| 6,296,318 | B1 * | 10/2001 | Simons et al. | 299/39.2 |
| 6,457,779 | B1 * | 10/2002 | Busley et al. | 299/39.2 |
| 6,623,083 | B1 | 9/2003 | Risi | |
| 8,177,456 | B2 * | 5/2012 | Haroldsen | 404/94 |
| 8,256,847 | B2 * | 9/2012 | Hall et al. | 299/39.4 |
| 2001/0047601 | A1 | 12/2001 | Keagle | |
| 2006/0078384 | A1 * | 4/2006 | Jacob et al. | 404/94 |
| 2009/0232598 | A1 | 9/2009 | Cochran et al. | |

OTHER PUBLICATIONS

Wirtgen GmbH; Exhibit A—drawing from WIDOS electronic spare parts catalog; 1 page; published no later than Dec. 31, 2010, by Wirtgen America, Inc. in the United States.*

* cited by examiner

*Primary Examiner* — David Bagnell
*Assistant Examiner* — Michael Goodwin
(74) *Attorney, Agent, or Firm* — Liell & McNeil Attorneys, PC

(57) ABSTRACT

A cold planer includes a frame and a cutting mechanism having a rotatable cutter configured to cut material of a substrate. An anti-slabbing mechanism is coupled to the frame and includes an upwardly oriented base plate, and a plurality of skids. The skids are arranged in a first subset and a second subset positioned upon opposite outboard sides of a forwardly projecting plow, and downwardly depend from a base plate of the anti-slabbing mechanism, for applying a slabbing opposition force to uncut material of the substrate.

18 Claims, 6 Drawing Sheets

COLD PLANAR ANTI-STABBING MECHANISM

TECHNICAL FIELD

The present disclosure relates generally to the field of cold planing, and more particularly to an anti-slabbing mechanism for a cold planer having a plurality of skids downwardly depending from a base plate.

BACKGROUND

Road planing is the practice of removing an upper layer of paving material from a traffic bearing substrate forming a road. Paving material used in road construction tends to deteriorate over time as a result of weathering, traffic wear, fatigue, biological processes and still other factors. It is common practice for new "lifts" of paving material to be paved upon older, worn layers. Eventually, however, it becomes impractical to build the road any higher, and some or all of the road needs to be rebuilt. Cold planers are commonly used to cut old paving material from the traffic bearing substrate to enable the placement of new paving material on top.

A typical cold planer is a self-propelled machine or attachment to a self-propelled machine that includes a cutting mechanism configured to remove paving material to some specified depth, rendering a more or less planar surface to serve as a grade upon which a new mat of paving material is to be placed. The process of cold planing tends to be fairly demanding, as substantial energy may be required to cut the relatively hard and dense substrate, then elevate the cut material to a conveyor for off-loading from the cold planer. It will thus be readily understood that the service environment of cold planers tends to be harsh, and the components of such machines subjected to quite demanding conditions.

Among other challenges, in certain instances the cutting mechanism of a cold planer may break off relatively large slabs of paving material which the conveyor and other subsystems have difficulty in handling. U.S. Pat. No. 4,221,434 to Swisher, Jr. et al. is directed to a Roadway Breaker Plate For A Planar Apparatus, in which a drum type planer cutter removes a top portion of an existing roadway. The breaker plate appears to provide a counteracting shearing force on the top portion of the roadway at a predetermined distance from the planer cutter, to remove cuttings from the roadway of purportedly uniform size. The design proposed by Swisher, Jr. et al. may work well for certain cold planer designs, but there is always room for improvement and broadened applicability.

SUMMARY

In one aspect, a cold planer includes a frame having a front frame end and a back frame end, and ground engaging propulsion elements coupled to the frame. A cutting mechanism is also coupled to the frame and includes a housing defining a cutting chamber, and a rotatable cutter positioned within the housing and configured to cut material of a substrate underlying the cold planer. The cold planer further includes an anti-slabbing mechanism coupled to the frame and including an upwardly oriented base plate extending across a front side of the cutting chamber, a forwardly projecting plow, and a plurality of skids. The plurality of skids are arranged in a first subset positioned on a first outboard side of the plow, and a second subset positioned on a second outboard side of the plow, and downwardly depending from the base plate such that the plurality of skids define a substrate contacting footprint of the anti-slabbing mechanism, for applying a slabbing opposition force to uncut material of the substrate.

In another aspect, an anti-slabbing mechanism for a cold planer includes an upwardly oriented base plate positionable across a front side of a cutting chamber in the cold planer, the base plate including an upper and a lower peripheral edge, and a first and a second outboard peripheral edge. The anti-slabbing mechanism further includes a plow projecting forwardly from the base plate, for plowing loose material upon a substrate underlying the cold planer, and a plurality of skids arranged in a first subset positioned on a first outboard side of the plow, and a second subset positioned on a second outboard side of the plow. The plurality of skids downwardly depend from the base plate and define a substrate contacting footprint, for applying a slabbing opposition force of the anti-slabbing mechanism to uncut material of the substrate positioned forwardly of a rotatable cutter within the cutting chamber.

In still another aspect, an anti-slabbing mechanism for a cold planer includes an upwardly oriented base plate positionable across a front side of a cutting chamber in the cold planer, the base plate including an upper and a lower peripheral edge, and a first and a second outboard peripheral edge. The anti-slabbing mechanism further includes a plow projecting forwardly from the base plate, for plowing loose material upon a substrate underlying the cold planer. The anti-slabbing mechanism further includes a first group of mounts coupled to the base plate and positioned along the lower peripheral edge on a first outboard side of the plow, and a second group of mounts coupled to the base plate and positioned along the lower peripheral edge on a second outboard side of the plow. Each of the first and second groups of mounts have a plurality of bolt holes formed therein and are configured to receive a plurality of bolts, for coupling a plurality of substrate contacting skids to the base plate.

DETAILED DESCRIPTION

Figure 1:
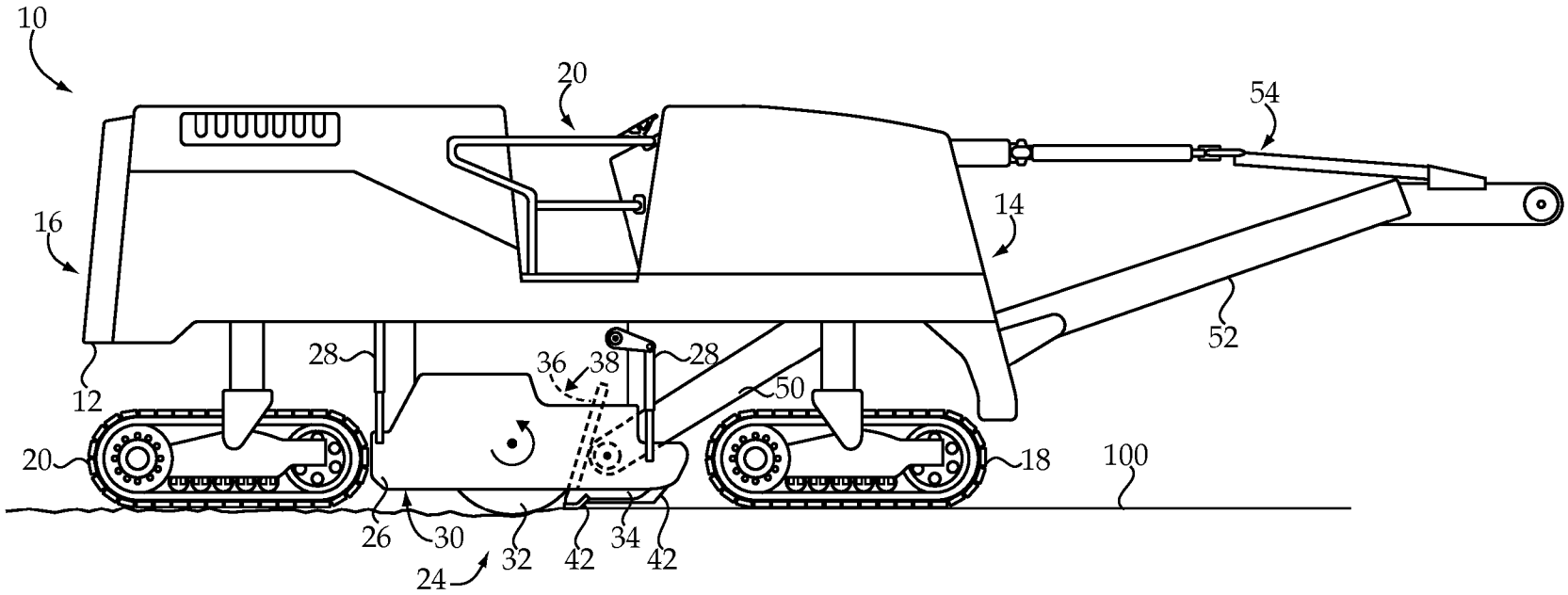
FIG. 1 is a side diagrammatic view of a cold planer according to one embodiment.

Referring to FIG. 1, there is shown a cold planer 10 according to one embodiment, and including a frame 12 having a front frame end 14 and a back frame end 16. A front set of ground engaging propulsion elements 18 and a back set of ground engaging propulsion elements 20 are coupled to frame 12. Each of the sets of propulsion elements 18 and 20 may include two parallel ground engaging tracks, although the present disclosure is not thereby limited. An operator control station 22 is coupled to frame 12 for conventional control and monitoring functions. Cold planer 10 may further include a cutting mechanism 24 coupled to frame 12 and having a housing 26 defining a cutting chamber 30. A set of actuators 28 are provided to raise and lower housing 26, typically in conjunction with adjustments to a cutting depth of mechanism 24 in a manner that will be familiar to those skilled in the art. Mechanism 24 includes rotatable cutter 32 which may rotate in a direction counter to a forward travel direction of cold planer 10, and is positioned within housing 26 and configured to cut material of a substrate 100 underlying cold planer 10. An anti-slabbing mechanism 34 is coupled to frame 12 and includes an upwardly oriented base plate 36 extending across a front side 38 of cutting chamber 24, a forwardly projecting plow 40 for plowing loose material lying upon substrate 100, and a plurality of skids 42. A primary conveyor 50 is positioned forwardly of base plate 36, and as further described herein may be coupled to and supported upon base plate 36, for feeding material cut from substrate 100 via cutter 32 to a secondary conveyor 52 projecting forwardly from frame 12. A positioning mechanism 54 may be coupled with secondary conveyor 52, to enable left, right, and potentially up and down position control of secondary conveyor 52 for conventional purposes. As will be further apparent from the following description, various design features of cold planer 10 are contemplated to enable improvements in efficiency, prolonged service life, and other desirable advancements over the state of the art.

Figure 2:
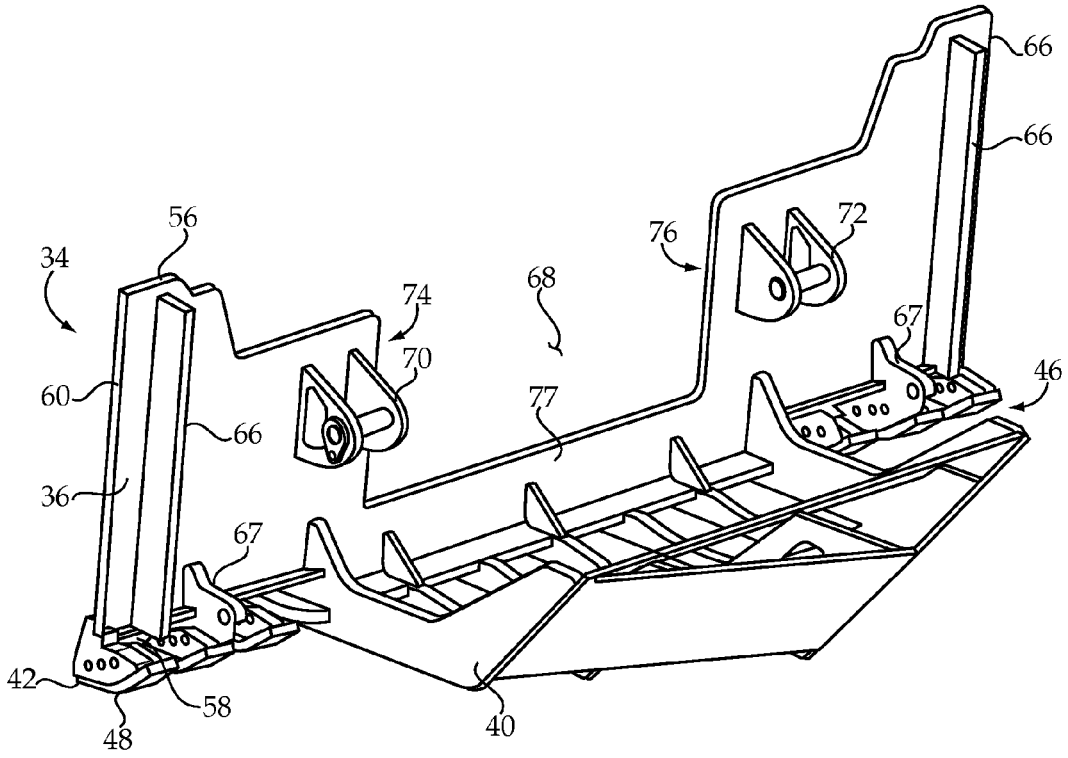
FIG. 2 is a diagrammatic view of an anti-slabbing mechanism according to one embodiment, from a first viewpoint.
Figure 3:
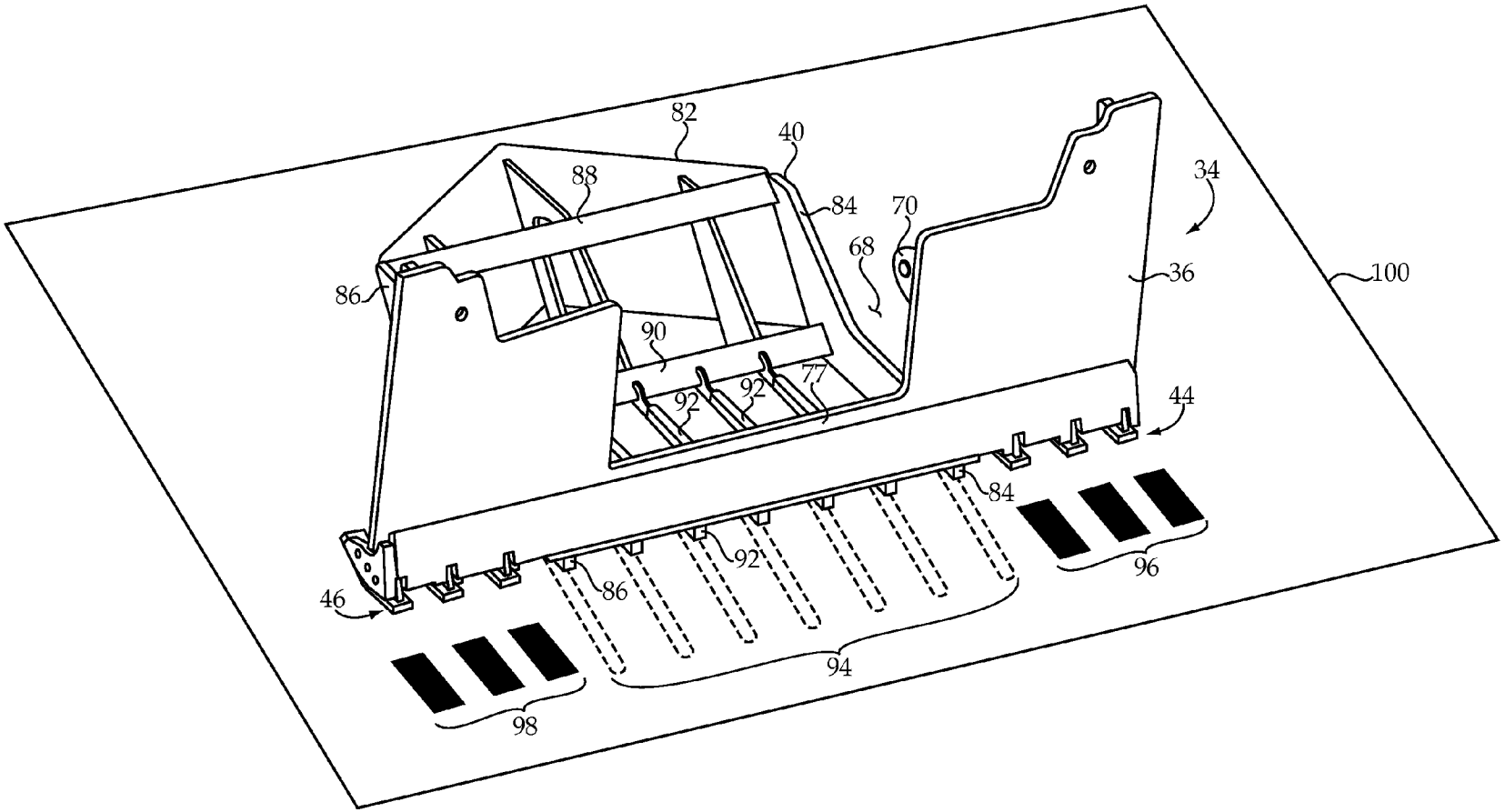
FIG. 3 is a diagrammatic view of the anti-slabbing mechanism of FIG. 2, from a different viewpoint.
Figure 4:
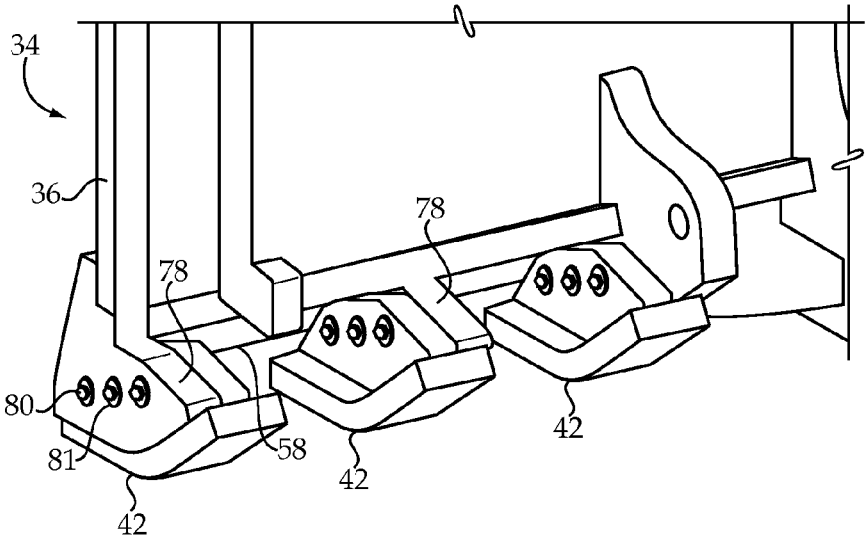
FIG. 4 is an enlarged view of a portion of the anti-slabbing mechanism of FIGS. 2 and 3.

Referring also now to FIGS. 2, 3 and 4 there are shown additional features of anti-slabbing mechanism 34 in several different views. As noted above, base plate 36 is positionable across a forward side of cutting chamber 30. Accordingly, as material is cut from a substrate, the rotating motion of cutter 32, and optionally additional material feeding mechanisms such as so called "kicker paddles" (not shown), will tend to urge material cut from the substrate in a forward direction toward base plate 36. Base plate 36 may include an upper peripheral edge 56, a lower peripheral edge 58, a first outboard peripheral edge 60 and a second outboard peripheral edge 62. Base plate 36 may further define a material transfer opening 68 through which the cut material is fed to reach primary conveyor 50. Primary conveyor 50 may thus be positioned adjacent opening 68 and configured to receive cut material passed therethrough from cutting chamber 30. Base plate 36 may also include a shielding wall 77 adjoining opening 68 and extending upwardly between primary conveyor 50 and cutting chamber 30, for purposes which will be apparent from the following description. As noted above, conveyor 50 may be coupled to anti-slabbing mechanism 34, and in particular may be pivotably mounted to base plate 36. To this end, mechanism 34 may further include a first conveyor mount 70 and a second conveyor mount 72 attached to base plate 36 and positioned upon a first outboard side 74 and a second outboard side 76 of opening 68, respectively. A first and a second actuator mount 67 may also be coupled to base plate 36 and configured to couple with actuators for adjusting a height of mechanism 34 for transport or during service in cold planer 10. A first and a second guide rail 66 of mechanism 34 are shown attached to base plate 36 adjacent edges 60 and 62, respectively.

Plow 40 projects forwardly from base plate 36 as mentioned above, and may include a blade 82, and a first support arm 84 and a second support arm 86 extending between base plate 36 and blade 82. A plurality of transverse plates, and in the illustrated embodiment a front plate 88 and a back plate 90, may extend between first and second support arms 84 and 86. A plurality of elongate ribs may also extend between base plate 36 and blade 82. Additional structural plates (not numbered) may be provided which attach to plates 88 and 90 as well as to blade 82. It may be noted, best in FIG. 2, that plow 40 extends vertically upwardly a distance which may be equal to or greater than about one-fifth of a height of base plate 36 as measured from lower peripheral edge 58 to a vertically uppermost part of upper peripheral edge 56. This feature is considered to enable blade 82 to push loose material lying upon a substrate downwardly and to the side, to prevent the material spilling over the top of blade 82 and thus contacting an underside of conveyor 50 during service. Plates 88 and 90 may assist in protecting conveyor 50 from any material which does happen to spill over blade 82. These features contrast with earlier strategies, employing a relatively shorter plow lacking structural and/or shielding plates which in some instances suffered from problems associated with loose material spilling over the top of the plow.

In a practical implementation strategy, skids 42 may be arranged in a first subset 44 positioned on a first outboard side of plow 40, and a second subset 46 positioned on a second outboard side of plow 40. Each of skids 42 may be positioned underneath base plate 36, and includes a downwardly facing lower surface 48, the downwardly facing lower surfaces defining a common horizontal plane. Skids 42 may also downwardly depend from base plate 36, and define a substrate contacting footprint of mechanism 34, for applying a slabbing opposition force to uncut material of a substrate. Positioning skids 42 in the manner described herein, and in certain embodiments such that first and second subsets 44 and 46 downwardly depend from lower peripheral edge 58, makes lower surfaces 48 of each of skids 42 the lowest point in space of anti-slabbing mechanism 34 when positioned for service in cold planer 10.

First and second subsets 44 and 46 may further be understood to be positioned subjacent to plow 40, and such that a vertical clearance extends between plow 40 and the common horizontal plane defined by lower surfaces 48. As best shown in FIG. 3, plow 40 defines a second footprint 94 coinciding with the vertical clearance. Although unevenness in substrate 100, and in some instances buckling and breaking of substrate 100, could cause substrate material to contact an underside of plow 40, when mechanism 34 rests upon a flat surface plow 40 will typically "float" and be separated from the flat surface via the vertical clearance. In FIG. 3, for illustrative purposes mechanism 34 is shown elevated from the plane of substrate 100, although during operating cold planer 10 mechanism 34 will of course contact substrate 100. Outboard of footprint 94 is a first group of parallel stripes 96 associated with subset 44 of skids 42, and a second group of parallel stripes 98 associated with subset 46. Each of the groups of stripes 96 and 98 includes three parallel stripes, with the respective groups parallel to each other and typically occupying the same locations in a front to back direction. In a practical implementation strategy, each of first and second subsets 44 and 46 includes a number of skids 42 equal to at least two, and is elongated in a front to back direction such that the substrate contacting footprint has the general form of two groups of parallel stripes as in FIG. 3, although different skid configurations and numbers could impart a different geometry to the substrate contacting footprint.

Referring now in particular to FIG. 4, mechanism 34 may further include a plurality of skid mounts 78 irreversibly coupled to base plate 36. Skid mounts 78 may be arranged in a first group corresponding to first subset 44 of skids 42, and a second group corresponding to second subset 46 of skids 42. Mounts 78 may be positioned along lower peripheral edge 58 with the respective groups of mounts positioned upon opposite outboard sides of plow 40. Each of mounts 78 may have a plurality of bolt holes 81 formed therein which are configured to receive a plurality of bolts 80 passed therethrough, for reversibly coupling skids 42 one to each of mounts 78. It may be noted from FIG. 4 that mounts 78 may be understood to hang from lower peripheral edge 58, and thus adapted to position skids 48 underneath lower peripheral edge 58.

Figure 5:
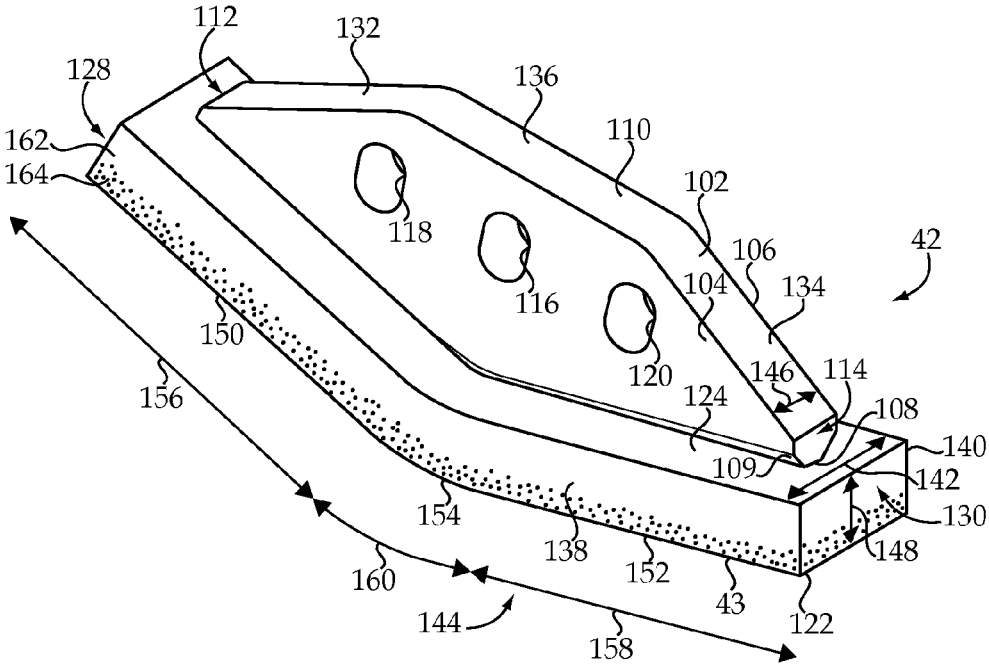
FIG. 5 is a pictorial view of a skid according to one embodiment.

Referring now to FIG. 5, there is shown one of skids 42. Each of the plurality of skids 42 in anti-slabbing mechanism 34 may be identical, and may be reversible such that upon wearing down material of lower surface 48 in a first service orientation, the skids may be reversed and used in an equivalent second service orientation. Skid 42 may include an elongate mounting plate 102 configured to be bolted to mechanism 34, and having a first side surface 104, a second side surface 106, a lower peripheral edge 108, and an upper peripheral edge 110. Upper peripheral edge 110 extends from a first mounting plate end 112 to a second mounting plate end 114. Each of side surfaces 104 and 106 may be planar, and side surfaces 104 and 106 may be parallel to one another. Mounting plate 102 may define a slotted bolt hole 116 communicating between first and second side surfaces 104 and 106 and configured to receive a bolt, for mounting skid 42 to anti-slabbing mechanism 34 in either of the first or second service orientations. In a practical implementation strategy, mounting plate 102 may define a second slotted bolt hole 118 and a third slotted bolt hole 120. The use of slotted bolt holes enables relatively minor adjustments to the positioning of skid 42 when coupled to the corresponding mount 78.

Skid 42 may further include an elongate curved runner plate 122 attached to lower peripheral edge 108 and having an upper surface 124, and also including substrate contacting lower surface 48. Lower surface 48 extends from a first runner plate end 128 to a second runner plate end 130 and has a curvilinear longitudinal profile. Upper peripheral edge 110 of mounting plate 102 may include a first edge segment 132, a second edge segment 134, and a middle edge segment 136, where the respective edge segments together define an angular longitudinal profile. While the transitions among segments 132, 134 and 136 may be radiused, the longitudinal profile defined by upper peripheral edge 110 may be understood to be angular in comparison with the curvilinear profile of lower surface 48. In one embodiment, runner plate 122 may include a first outboard edge 138 and a parallel second outboard edge 140, each of which is planar, such that runner plate 122 has a uniform rectangular cross section as shown in FIG. 5.

Runner plate 122 may also include a width 142 extending from first outboard edge 138 to second outboard edge 140, and a length 144 extending from first runner plate end 128 to second runner plate end 130. Length 144 may be greater than width 142 by a factor of four or greater, and in certain embodiments may be greater than width 142 by a factor of six or greater. Mounting plate 102 may include a mounting plate thickness 146 between first side surface 104 and second side surface 106, and runner plate 122 may include a runner plate thickness 148 between upper surface 124 and lower surface 43. Each of thicknesses 146 and 148 may be from about 15 mm to about 25 mm. As used herein, the term "about" should be understood in the context of rounding to a consistent number of significant digits. Accordingly, "about 15 mm" means from 14.5 mm to 15.4 mm. Lower surface 48 may include a first planar segment 150 adjoining first runner plate end 128, a second planar segment 152 adjoining second runner plate end 130, and an arcuate segment 154 extending between planar segments 150 and 152. As noted above, length 144 extends from first end 128 to second end 130. Length 144 may be comprised of length segments defined by each of surfaces 150, 152 and 154. In particular, a length 156 of first planar segment 150 and a length 158 of second planar segment 152 may each be greater than a length 160 of arcuate segment 154. In one embodiment, each of lengths 156 and 158 may be greater than length 160 by a factor of two or greater. Lengths 156 and 158 may also be equal to one another, and equal to about 100 mm in certain embodiments.

As noted above, runner plate 122 may be attached to lower peripheral edge 108 of mounting plate 102. Mounting plate 102 and runner plate 122 may each be formed at least in part from rolled steel, castings, forgings, and the like, and may be welded together. A bevel 109 may extend longitudinally along each side of a welded interface between the respective components. Runner plate 122 may also include a lower wear material layer 164 having a greater hardness, and an upper base material layer 162 having a lower hardness. The respective layers may be layers of different hardness steel, iron, or alloys thereof. In a practical implementation strategy, wear material layer 164 may be a hard-facing material applied to base material layer 162 by way of spray welding, or any other suitable cladding technique. Mounting plate 102 may be formed of the base material.

Figure 7:
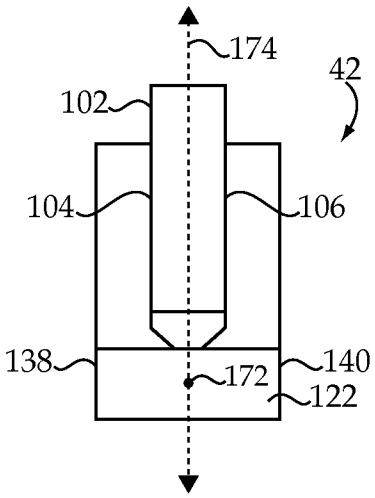
FIG. 7 is an end diagrammatic view of the skid of FIGS. 5 and 6.
Figure 6:
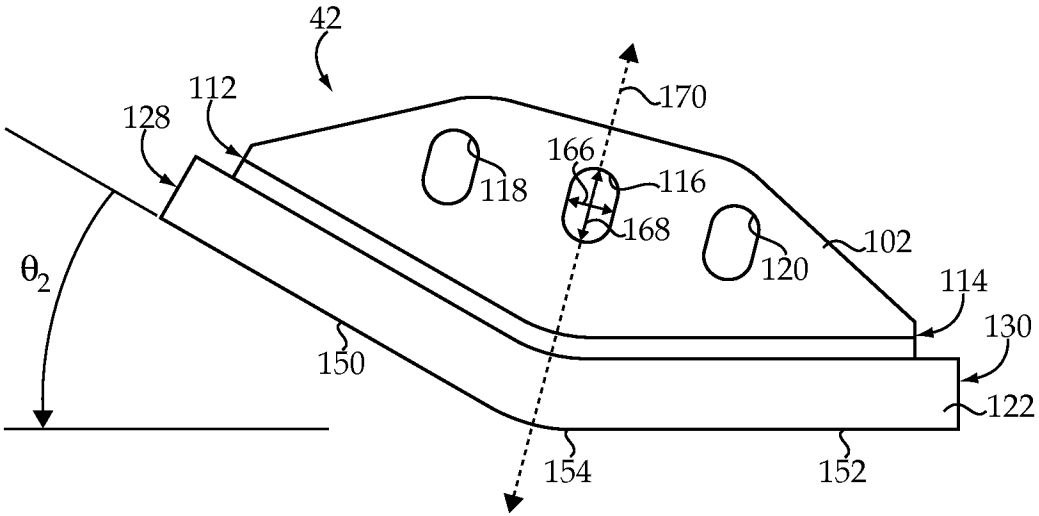
FIG. 6 is a side diagrammatic view of the skid of FIG. 5.

Referring now also to FIGS. 6 and 7, there are illustrated additional features of skid 42. As noted above, bolt hole 116 may be one of a plurality of slotted bolt holes formed in mounting plate 102. Each of bolt holes 116, 118 and 120 may be oblong as shown, and bolt hole 116 includes a minor diameter 166, and a major diameter 168. Major diameter 168 may define a plane 170 bisecting runner plate 122, and also bisecting middle edge segment 136. The curvilinear longitudinal profile of lower surface 43 may be symmetric about plane 170 such that skid 42 defines an identical substrate contacting footprint in each of the first and second service orientations. In a practical implementation strategy, plane 170 includes a first plane of mirror image symmetry bisecting skid 42 between first and second runner plate ends 128 and 130. Thus, a first longitudinal half of skid 42 may be positioned on a first side of plane 170, and a second longitudinal half of skid 42 is positioned on a second side of plane 170 and is a mirror image of the first longitudinal half. It will thus be understood that skid 42 may be rotated 180° from the service orientation shown in FIG. 6, and mounted to anti-slabbing mechanism 34 in a second service orientation to perform identically as it did in the prior service orientation. It may also be noted from FIG. 6 that planar segments 150 and 152 are oriented at an angle $\theta_2$ relative to one another. In certain embodiments, angle $\theta_2$ may be equal to about 45° or less, and in a practical implementation strategy may be equal to about 30°. Such angles have been discovered to be advantageous in the intended service environment of cold planer 10, in which skids 42 slide upon generally flat, compacted asphalt.

The form of symmetry illustrated and discussed in connection with FIG. 6 may be understood as longitudinal symmetry. Skid 42 may also be latitudinally symmetric. FIG. 7 illustrates a longitudinal centerline 172 of runner plate 122. Longitudinal centerline 172 lies in a second plane 174 oriented perpendicular to first plane 172 and bisecting skid 42 between first and second side surfaces 104 and 106. Second plane 174 may be a plane of mirror image symmetry, such that a first lateral half of skid 42 is positioned on a first side of plane 174, and a second lateral half of skid 42 is positioned on a second side of second plane 174 and is a mirror image of the first lateral half.

INDUSTRIAL APPLICABILITY

Figure 8:
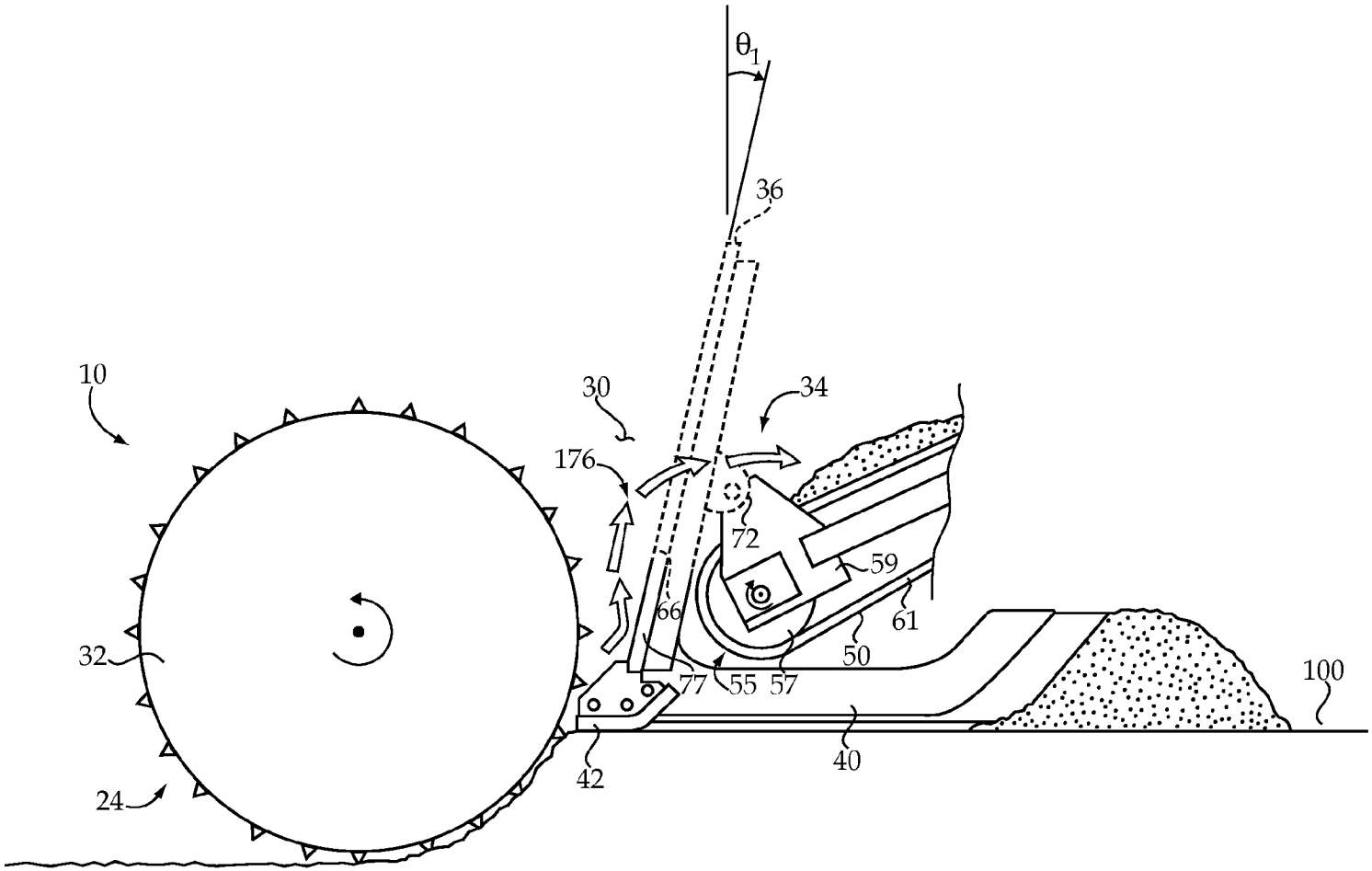
FIG. 8 is a side diagrammatic view of a portion of the cold planer of FIG. 1, shown cutting material of a substrate.

Referring now to FIG. 8, there is shown a portion of cold planer 10, including cutter 24, anti-slabbing mechanism 34, and conveyor 50, as those components might appear when cold planer 10 is advancing in a forward travel direction across substrate 100, and cutter 32 being rotated within cutting chamber 30 during the advancement, such that cutter 32 cuts material from substrate 100. Cutter 32 is rotating counter to the forward travel direction, and is thus cutting material from substrate 100 and feeding the cut material upward and forward to conveyor 50. Conveyor 50 is shown supported upon base plate 36, and receives material fed through opening 68. Arrows 176 show an approximate feed path for the cut material. Plow 40 projects forwardly of base plate 36 and pushes loose material lying upon substrate 100. In many instances, personnel will place the loose material in front of plow 40 to enable it to be fed to conveyor 50. In general, plow 40 will push the material to the side so that it passes under base plate 36 and between skids 42. A tail 55 of conveyor 50 is positioned adjacent to base plate 36 and includes a tail pulley 57 rotated to move a belt 61 in a conventional manner. A bracket 59 couples conveyor 50 to mount 72. It may be noted that plow 40 is positioned at a clearance with substrate 100, although the clearance may be as small as 10 mm or less, potentially equal to about 4 mm. A skid 42 is shown contacting substrate 100, and applies a slabbing opposition force to substrate 100. The slabbing opposition force may be based at least in part upon a weight of anti-slabbing mechanism 34, and pushes downwardly upon uncut material positioned forwardly of cutter 32 to hold the uncut material in place and prevent its breaking off from substrate 100 in slabs too large to be practically accommodated by cold planer 10, and in particular conveyor 50. The slabbing opposition force may also be based in part upon approximately one half the weight of conveyor 50, and could be augmented via downward force provided by hydraulic cylinders coupled with mechanism 34. It has been observed that breaking off slabs of material from a substrate can stress and damage equipment. Although only one skid 42 is shown in FIG. 8, the illustrated skid will be understood to be one of a plurality of skids, each having coplaner lower surfaces upon elongate runner plates, as described herein.

It may be noted that a lowermost one of arrows 176 in FIG. 8 shows a curving path as might be expected where cut material from substrate 100 is urged upwardly via the rotation of cutter 32, and then deflected via shielding wall 77. As a result, relatively high velocity material can be prevented from directly impinging upon tail 55 of conveyor 50. It was observed in certain prior anti-slabbing mechanisms that a lack of shielding could sometimes result in chunks of material cut from a substrate impacting a tail of a primary conveyor and reducing the service life thereof. It will be recalled that a cutting depth of cold planer 10 may be adjusted, varying a position of cutter 32 relative to mechanism 34, and thus conveyor 50. As a result, the relative position of cutter 22 with respect to shielding wall 77 may be different from that illustrated in FIG. 8 in certain circumstances. Mechanism 34 may nevertheless be configured to shield at least a portion of tail 55 of conveyor 50 from cut material being fed to conveyor 50 in certain service configurations.

While anti-slabbing mechanism 34 will typically be vertically adjustable, e.g. raised or lowered, an orientation of mechanism 34 with respect to substrate 100 will typically remain fixed during operation of cold planer 10. In this vein, base plate 36 may be supported at a fixed orientation which is tilted forwardly with respect to a horizontal plane, approximately as shown in FIG. 8. In a practical implementation strategy, base plate 36 may be tilted forwardly such that it defines an angle $\theta_1$ from about 5° to about 15°, with respect to a vertical line, and in particular $\theta_1$ may be equal to about 8° in certain embodiments. The forward tilt of base plate 36 can enable the positioning of skid 42, and the other skids not visible in FIG. 8, relatively close to cutter 32 and thus enhance the overall effectiveness of anti-slabbing mechanism 34, since the slabbing opposition force is applied close to a forwardly advancing cutting line defined by cutter 32.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A cold planer comprising:

a frame having a front frame end and a back frame end;

ground engaging propulsion elements coupled to the frame;

a cutting mechanism coupled to the frame and including a housing defining a cutting chamber, and a rotatable cutter positioned within the housing and configured to cut material of a substrate underlying the cold planer;

an anti-slabbing mechanism coupled to the frame and including an upwardly oriented base plate extending across a front side of the cutting chamber, a forwardly projecting plow, and a plurality of skids, and the anti-slabbing mechanism being vertically adjustable between a raised position and a lowered position and supported at a fixed orientation relative to a plane extending horizontally beneath the frame, at each of the raised and lowered positions; and a conveyor mounted to the base plate and being pivotable relative to the base plate, wherein the plurality of skids are arranged in a first subset positioned on a first outboard side of the plow, and a second subset positioned on a second outboard side of the plow, and downwardly depend from the base plate such that the plurality of skids define a substrate contacting footprint of the anti-slabbing mechanism, for applying a slabbing opposition force to uncut material of the substrate, and wherein the plurality of skids each include a mounting plate and a curved runner plate attached to the mounting plate, the curved runner plate having a central arcuate segment.

2. The cold planer of claim 1 wherein each of the plurality of skids is positioned underneath the base plate and includes a downwardly facing lower surface, and the downwardly facing lower surfaces defining a common horizontal plane.

3. The cold planer of claim 2 wherein the base plate is tilted forwardly with respect to the common horizontal plane.

4. The cold planer of claim 2 wherein the first and second subsets of the plurality of skids are positioned subjacent to the plow, such that a vertical clearance extends between the plow and the common horizontal plane, and the plow defines a second footprint coinciding with the vertical clearance.

5. The cold planer of claim 4 wherein each of the first and second subsets includes a number of the skids equal to at least two, and wherein each of the plurality of skids is elongated in a front to back direction such that the substrate contacting footprint has the form of a first and a second group of parallel stripes associated with the first and second subsets of the plurality of skids, respectively.

6. The cold planer of claim 2 wherein the curved runner plate of each of the plurality of skids includes the downwardly facing lower surface located thereon.

7. The cold planer of claim 6 wherein the anti-slabbing mechanism further includes a plurality of skid mounts irreversibly coupled to the base plate, and a plurality of bolts reversibly coupling each of the mounting plates to one of the plurality of skid mounts.

8. The cold planer of claim 2 wherein the base plate further includes an upper and a lower peripheral edge, and a first and a second outboard peripheral edge, and wherein each of the first and second subsets of the plurality of skids downwardly depends from the lower peripheral edge.

9. The cold planer of claim 8 wherein the base plate further includes a material transfer opening formed therein, and the conveyor being positioned adjacent the material transfer opening and configured to receive cut material passed through the material transfer opening from the cutting chamber.

10. The cold planer of claim 9 wherein the anti-slabbing mechanism further includes a first and a second conveyor mount coupled to the conveyor, and attached to the base plate upon a first and a second outboard side of the material transfer opening, respectively.

11. The cold planer of claim 9 wherein the base plate further includes a shielding wall adjoining the material transfer opening and extending upwardly between the conveyor and the cutting chamber.

12. The cold planer of claim 1 wherein the mounting plate of each of the plurality of skids has at least one oblong mounting hole.

13. An anti-slabbing mechanism for a cold planer comprising:

an upwardly oriented base plate positionable across a front side of a cutting chamber in the cold planer, the base plate including an upper and a lower peripheral edge, and a first and a second outboard peripheral edge;

a plow projecting forwardly from the base plate, for plowing loose material upon a substrate underlying the cold planer; and a plurality of skids arranged in a first subset positioned on a first outboard side of the plow, and a second subset positioned on a second outboard side of the plow, wherein the plurality of skids downwardly depend from the base plate and defining a substrate contacting footprint, for applying a slabbing opposition force of the anti-slabbing mechanism to uncut material of the substrate positioned forwardly of a rotatable cutter within the cutting chamber, wherein the first and second subsets of the plurality of skids are positioned subjacent to the plow, such that a continuous clearance extends vertically between the plow and a common horizontal plane defined by the plurality of skids, and horizontally from the first subset of the plurality of skids to the second subset, and wherein the plurality of skids each include a mounting plate and a curved runner plate attached to the mounting plate, the curved runner plate having a central arcuate segment.

14. The anti-slabbing mechanism of claim 13 wherein the base plate defines a material transfer opening, for passing cut material from the cutting chamber to a conveyor of the cold planer, and further including a first and a second conveyor mount attached to the base plate and positioned upon a first and a second outboard side of the material transfer opening, respectively.

15. The anti-slabbing mechanism of claim 13 further including a plurality of skid mounts irreversibly coupled to the base plate, and a plurality of bolts reversibly coupling each of the plurality of skids to one of the plurality of skid mounts.

16. The anti-slabbing mechanism of claim 15 wherein the curved runner plate of each of the plurality of skids includes a downwardly facing lower surface, and the downwardly facing lower surfaces define a common horizontal plane.

17. The anti-slabbing mechanism of claim 16 wherein the base plate is tilted forwardly with respect to the common horizontal plane.

18. The anti-slabbing mechanism of claim 13 wherein the plow includes a blade, a first and a second support arm extending between the base plate and the blade, and a plurality of transverse plates each extending between the first and second support arms.

* * * * *

UNITED STATES PATENT AND TRADEMARK OFFICE

CERTIFICATE OF CORRECTION

PATENT NO. : 8,915,550 B2
APPLICATION NO. : 13/414759
DATED : December 23, 2014
INVENTOR(S) : Jeevanantham et al.

It is certified that error appears in the above-identified patent and that said Letters Patent is hereby corrected as shown below:

Title Page, Column 1, Item 54, (Title), lines 1-2, delete "COLD PLANAR ANTI-STABBING MECHANISM" and insert -- COLD PLANER ANTI-SLABBING MECHANISM. --.

Title Page, Column 2, Item 74, (Attorney, Agent, or Firm), lines 1-2, delete "Liell & McNeil Attorneys, PC" and insert -- Liell & McNeil Attorneys, PC; Baker Hostetler --.

In the Specification

Column 1, lines 1-2, delete "COLD PLANAR ANTI-STABBING MECHANISM" and insert -- COLD PLANER ANTI-SLABBING MECHANISM. --.

Signed and Sealed this
Twenty-fourth Day of November, 2015

Michelle K. Lee

Michelle K. Lee
*Director of the United States Patent and Trademark Office*